United States Patent [19]

Slocum

[11] Patent Number: 4,821,436

[45] Date of Patent: Apr. 18, 1989

[54] BLOW SYSTEM

[76] Inventor: Alexander H. Slocum, 550 Memorial Dr., Apt. 23B, Cambridge, Mass. 02139

[21] Appl. No.: 551,192

[22] Filed: Nov. 14, 1983

[51] Int. Cl.[4] ..... E01H 5/04

[52] U.S. Cl. ..... 37/235; 37/279; 37/283; 172/811

[58] Field of Search ..... 37/231, 235, 266, 270, 37/279, 283, 141 R; 172/811, 817–832

[56] References Cited

U.S. PATENT DOCUMENTS

| | | | |
|---|---|---|---|
| 1,839,285 | 1/1932 | Winkie | 37/266 |
| 1,967,379 | 7/1934 | Stewart | 172/823 |
| 2,059,431 | 11/1936 | Barrett et al. | 172/823 |
| 2,061,585 | 11/1936 | Meyer | 37/283 X |
| 2,276,586 | 3/1942 | McIntosh | 172/829 |
| 2,282,389 | 5/1942 | Argo | 172/829 X |
| 2,417,520 | 3/1947 | Porch | 172/829 |
| 2,446,220 | 8/1948 | Erdahl | 172/829 |
| 2,565,337 | 8/1951 | Allan | 172/818 |
| 2,682,717 | 7/1954 | Le Tourneau | 172/829 |
| 2,737,735 | 3/1956 | Westfall | 172/829 |
| 3,296,721 | 1/1967 | Coontz | 172/817 |
| 3,439,752 | 4/1969 | Coontz | 172/823 |
| 3,773,116 | 11/1973 | Coontz | 172/817 |
| 3,822,751 | 7/1974 | Waterman | 172/825 X |
| 3,934,654 | 1/1976 | Stephenson et al. | 37/141 R |
| 4,215,496 | 8/1980 | Wehr | 172/817 |
| 4,216,833 | 8/1980 | Fezatt et al. | 37/283 X |
| 4,222,442 | 9/1980 | Westendorf et al. | 172/822 X |
| 4,249,323 | 2/1981 | Mathis et al. | 172/820 X |

FOREIGN PATENT DOCUMENTS

| | | | |
|---|---|---|---|
| 874898 | 10/1981 | U.S.S.R. | 172/818 |
| 690664 | 4/1953 | United Kingdom | 172/829 |

*Primary Examiner*—Eugene H. Eickholt
*Attorney, Agent, or Firm*—Robert Shaw

[57] ABSTRACT

A high-performance plow system to be attached to a pickup truck or similar vehicle. The plow blade can be angled across the plowing surface and with respect to the motion of the vehicle up to about 45°, it can roll to allow the blade to track changing pitch angles along the plowing surface contours. The blade has two protective mechanisms, the first one being an appropriately-designed rake angle scraper structure, disposed at the bottom edge of the plow blade, the second one being a mechanism which attaches the blade to an A-frame assembly (AFA) by pitch and shear pins. The shear pins break if too tall an object is hit and allow the blade to fall over the object. The pins allow 30 second removal-/attachment of blade. The AFA is described as being L-shaped when viewed from a side view, which shape causes it to produce forces (that are necessary) to keep the blade's scraper structure on the plowing surface, and allows it to be raised to a substantially vertical position when the plow is in its inoperative mode. This reduces truck front-end wear, and increases maneuverability of the vehicle when not plowing.

19 Claims, 9 Drawing Sheets

BLOW SYSTEM

BACKGROUND OF THE INVENTION

1. Field of Invention

The present invention relates to plow systems which are designed to be easily attachable to light vehicles and the like.

2. Setting For the Invention

The major problems with most plow systems now available for use with light vehicles and light trucks are: (1) that they are easily damaged by obstacles (e.g., curbs, manhole covers, and drain grates) encountered during plowing; (2) that they are difficult to attach and then disconnect; (3) that the geometrical structure of their mounting brackets is such that it unnecessarily reduces the hill-approach angle of the vehicle; (4) that the blade yaw angles are unnecessarily limited; (5) that the ability of the blade to track (or roll with) the plowing surface's pitch is also unnecessarily limited; and (6) that the blades tend to damage roadways.

The above problems, when recognized, have been addressed in various ways, yet the basic geometries of preexisting systems conceived, exhibit that they have been designer selected with nonminimal compromise. Accordingly, the principle object of the present invention is to satisfy optimal design objectives with minimum compromise so that the major problems of preexisting plow systems can be overcome.

In conventional plow system designs, in order to enable the blade component thereof to remove all snow and ice accumulated from the plowing surface, and concurrently be capable of passing over rigid protruding objects from the plowing surface (such as manhole covers, pavement irregularities, curbs, etc.), conventional blades have been designed slightly curved, and they intersect the ground with a rake angle of about 70 degrees.

In the event that a rigid object is struck by the plow blade, one of two conventional types of blade protection have been hitherto designed and implemented into realization. The first protective blade mechanism allows the blade to tip forward and for the blade to slide over the encountered object. However, in this case, every time the blade tips the operator must replow a small section of the surface which the blade was not acting upon during the object disturbance. The second type of blade protection conventionally provided holds the upper part of the blade rigid while the lower four-or-so inches of the plow blade is hinged and is loaded by a compression-type spring from behind the blade. Thus, when the blade strikes a rigid object, the bottom edge of the blade momentarily folds under the blade structure assembly and allows the blade to glide over the encountered object. A major object of the present invention is to provide a blade geometry that overcomes the problems of damage done to the blade, to attaching assembly, to the road, and to the vehicle, due to road obstructions and to do so with a much simpler design.

In conventional plow system designs, the plow's A-frame assembly and blade are lowered into operating position and the blade angling (yawing) subsystem establishes the angular displacement of the blade using a hydraulic system. This choice not only contributes to a major part of the plow's manufacturing cost, but it limits the yaw angle of the blade to about thirty angular degrees measured about the longitudinal axis of the plow vehicle, as is later described. This performance limitation, set chiefly by —(1) design tradeoffs in the blade angling system's mechanical advantage against snow forces and (2) geometric/configurational constraints inherent in the placement of this subsystem's hydraulic cylinders on the plow's A-frame—poses a serious problem in achieving high plow performance. This limitation imposed upon the angular displacement of the blade is usually not enough to keep the angle of the plow's velocity vector constant with respect to the motion of the snow during sharp vehicle turns. Also, roll capability of the blade is due only to the elasticity of the plow's A-frame about the longitudinal reference axis of the vehicle's forward motion. Thus, when plowing on uneven roads or driveways having very large slopes (technically called roll), the bottom edge of the blade may not always track the contours of the surface being plowed. In order to overcome such problems, an electric winch/cable blade angling (yawing) subsystem and a blade connecting mechanism having three degrees of freedom have been incorporated into the present design, wherein, the design objectives (1) that the blade be capable of yawing forty-five degrees by remote control, and (2) that the blade be capable of rolling nine degrees, have been satisfied.

In a conventional plow system design, the plow system is attached to the vehicle beneath the front bumper. A chief shortcoming of this feature is that the connecting mechanism employed is unnecessarily bulky and can restrict ground clearance of the plow system as well as unnecessarily reduce the angle of the steepest hill that the vehicle is capable of approaching from a flat plane. In addition to ground clearance and vehicle approach angle problems, the conventional designs of plow system mounting brackets have posed other unnecessary problems; such as restricting access to the underside engine area for repairs. Still another object, therefore, is to provide an A-frame and mounting brackets which attach the blade to the vehicle and overcome the aforementioned difficulties.

Hitherto, conventional plow systems, which weigh from 500 to 800 pounds, have had approximately half of the mass of the plow system concentrated in the blade. The large weight poses great difficulty in connecting the system to the vehicle. Thus, most owners leave their plow systems connected to the vehicle between snow storms. Thus a large weight is held out in front of the vehicle during otherwise normal driving, which in turn creates a large moment of inertia acting upon the front end resulting in excessive and unnecessary wear on the vehicle and, in addition, causes vehicle handling difficulties thereby posing driver-safety problems. A further object, therefore, is to incorporate a blade connection mechanism into the plow system design in order to facilitate quick and easy connecting of the blade structure assembly to, and disconnecting it from, the plow system's A-frame assembly, in contrast with removing the entire plow system, off and away from the plow vehicle.

The foregoing and further objects are addressed hereinafter.

The above objects are attained, generally, in a plow to effect plowing action on a material at a surface, whereby the plow comprises: a blade having an arcuate-shell face region, and a bottom plate that interfaces with the material at the surface being plowed, where the bottom plate is secured to and extends along the lower edge of the arcuate-shell face region and is disposed at an angle $\phi$ to the portion of the face region of the blade to which it is secured. The bottom plate is also wide enough to place the upper portion thereof above rigid obstacles usually encountered during the course of plowing. The angle $\phi$ is the external angle formed between the face region of the plow blade and the bottom plate at the junction of the two structures and is an angle greater than 180° and less than 360°. The bottom plate is disposed at an angle $\alpha$ to the roadway. An A-frame assembly serves to attach the blade to a vehicle, and a blade connecting mechanism serves to attach the blade to the frame.

The invention is hereinafter described with reference to the accompanying drawing in which.

Figure 1:
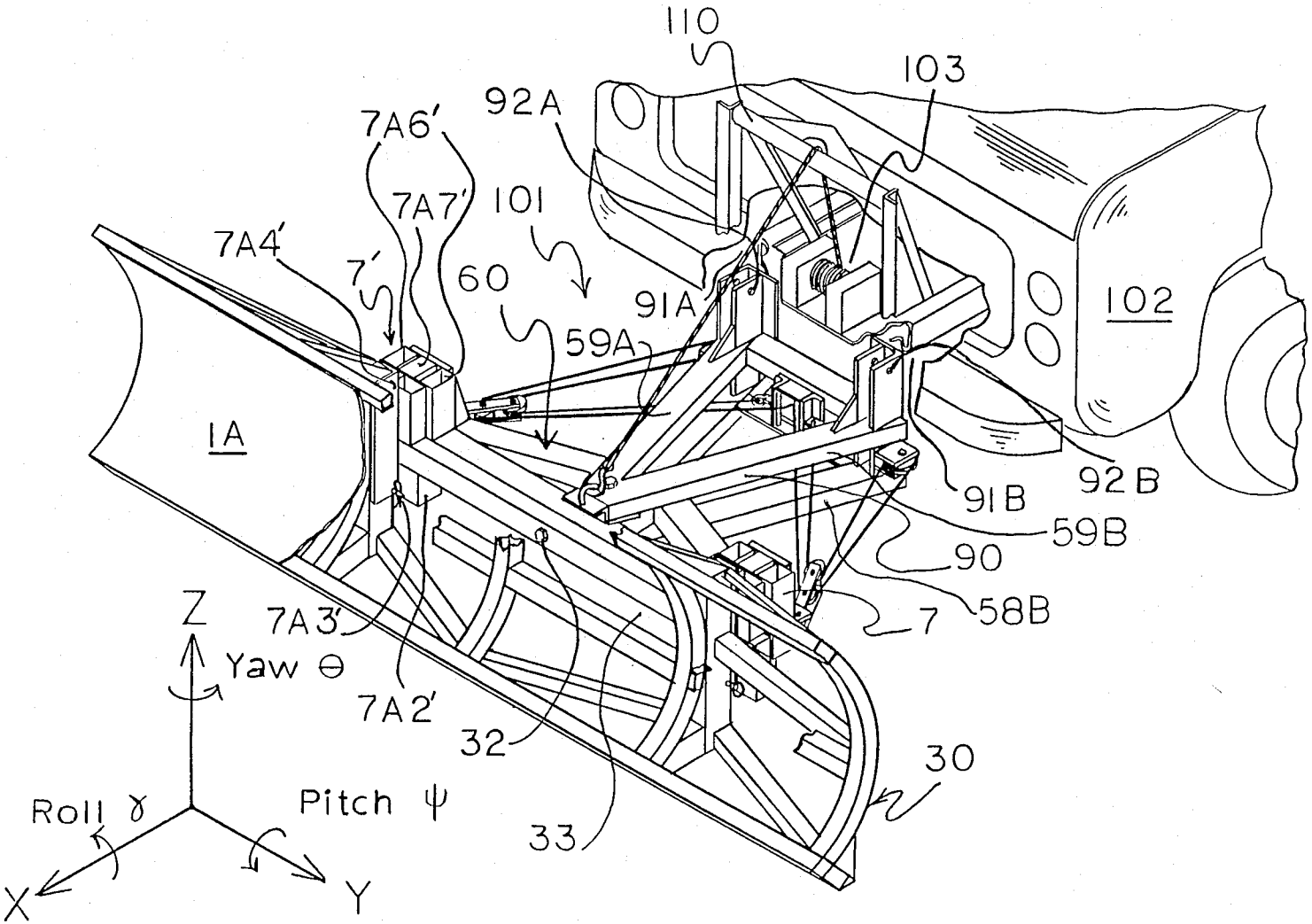
FIG. 1 is an isometric view showing the plow of the present invention (partly cutaway), attached to the front of a pickup truck or like vehicle by an A-frame to which the plow blade is attached by a blade connection mechanism.

Some preliminary comments of a general nature are appropriate at this juncture. The plow system marked by 101 in FIG. 1 is shown attached to a vehicle 102. The plow is in its operational configuration where a blade structure assembly 30 is connected by a blade connection mechanism 60 to an A-frame assembly 90, thence by mounting brackets 91A and 91B to a pickup truck or like vehicle. In general, the plow system 101 consists of the three major structural components just mentioned, specifically 30, 60, and 90, which when integrated together to yield the present type of plow system, renders it capable of actualizing several traditional plowing functions by means of specific structures and mechanisms contained herein and described and explained below. An ancillary component of the plow is the electrically powered crane mechanism labeled 103 which is mounted to the top of the plow vehicle front bumper.

Figure 2:
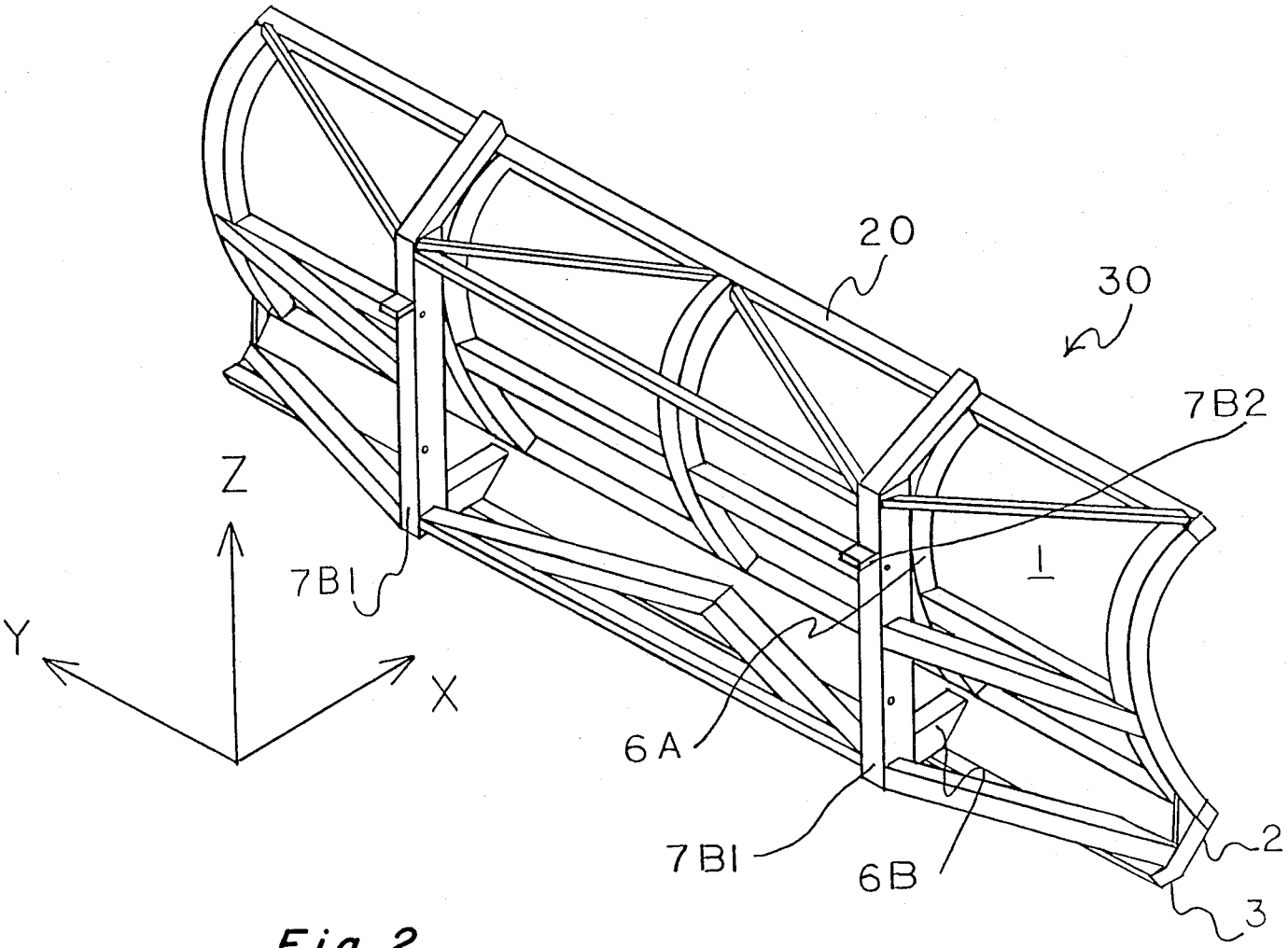
FIG. 2 is a rear, isometric skeletal view showing the blade of FIG. 1 and its supporting structure.
Figure 3:
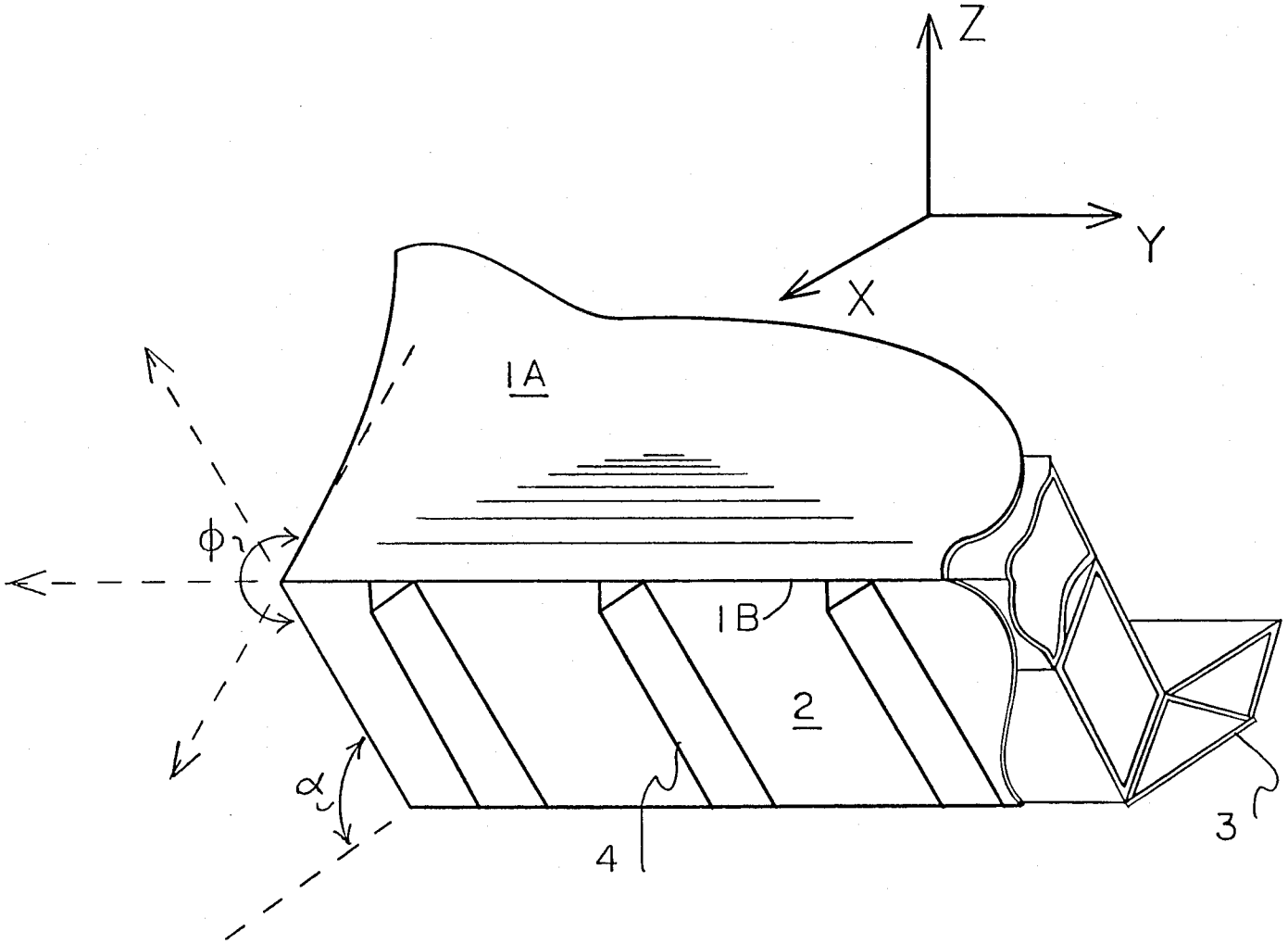
FIG. 3 is a front, isometric view showing the (partly cutaway) lower left corner of the bottom plate structure of the present invention, where a plurality of parallel-running ice scraper ridges are welded onto the front surface thereof.

The blade structure assembly 30, as shown in FIG. 2, includes a blade 1 and a support frame 20. Referring to FIGS. 1 and 3, the blade 1 has an arcuate-shell face region 1A. Disposed at the bottom of the blade 1, where it normally interfaces with the material at the surface that is being plowed, there is connected (to the support frame 20) a bottom plate 2 (FIG. 3) which is secured to and extends along the lower edge labeled 1B of the arcuate, substantially rectilinear, face region 1A of the plow blade 1 and is disposed at an angle $\phi$ to the portion of the face region 1A to which it is secured, and an angle $\alpha$ with respect to the ground, wherein the angle $\phi$ is the external angle (see FIG. 9) formed between the face region 1A of the plow blade 1 and the bottom plate 2 at the junction 1B of the two structures (i.e., 1A and 2) and wherein $\phi$ is also an angle greater than 180° and less than 360°. In fact, the optimal angle $\phi$ (for present purposes) has been empirically found to be about 240 angular degrees and $\alpha = 60$ angular degrees. The bottom plate 2 and its relationship to the face region 1A are of particular importance, as now explained.

As mentioned, one of the major problems with most snowplow systems now available for use with light vehicles and light pickup trucks, is that such systems are easily damaged when encountering obstacles (e.g., curbs, drain grates, manhole covers, etc.), and that they often pry up pieces of roadway or runways. To overcome the obstruction clearance problem, a particular blade tip design has been developed by the present inventor, as shown in FIG. 9 which discloses a blade tip that is not disposed out in front of the blade component, as is done in conventional designs, but is folded back.

Figure 9:
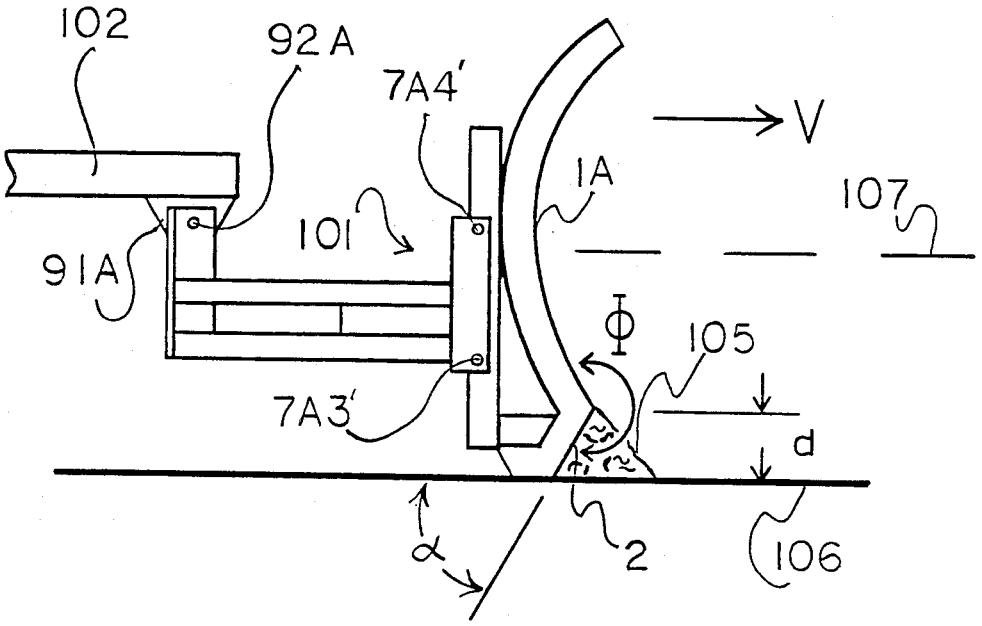
FIG. 9 is a side, schematic view of the geometry of the blade surface of the blade structure assembly and the A-frame assembly.

Referring to FIG. 9, it is shown that the present design effectively avoids and/or mitigates direct contact of the plow blade tip with encountered rigid objects upon striking them during the course of plowing. It does so by disposing the scraper thereof—not out and in front of the blade surface 1A, as is accomplished in conventional designs—but rather by folding it back towards the truck (FIG. 9) in order to form what is termed herein a reverse rake angle, denoted by the external angle $\phi$. Alternatively, the tip of the blade in accordance with the present invention can be said to be backwardly—rather than forwardly—oriented with respect to the direction of the system velocity vector V. The chief advantage of avoiding direct contact of the blade tip with rigid obstacles encountered during the course of plowing, is that a wedge-shaped accumulation of shaved ice and compressed snow 105 in FIG. 9, packed into the wedge-shaped cavity formed between the planar surface 2 and the plowing surface 106, acts like a renewable energy-absorbing material or buffer, thereby protecting the blade tip upon striking an encountered obstacle and preventing the blade tip from potentially digging up the roadway. This bottom edge is also useful on blades used to finish leveling earth surfaces. Furthermore, as the obstacle interacts with the compressed ice/snow medium 105 packed within the cavity, it absorbs a substantial amount of the transferred impact momentum and eventually comes in contact with the rake angle scraper, thereby exerting forces thereupon which are translated in the vertical direction, and thereby causing the entire plow assembly to rise from the plowing surface and clear the encountered obstacle.

The chief advantage of the present design is that upon encountering an obstacle during the course of plowing the compressed, wedge-shaped, ice block 105 initially makes direct contact with the obstacle and not with the planar surface 2 of the bottom plate, thereby protecting the plow system 101 from undue damage and unnecessary wear. Additionally, this also helps to keep the plow from digging up the roadway or other planar surfaces to be plowed.

Referring to FIG. 3, some of the finer structures and features of the present plow blade design are now further described and given enhanced focus. The bottom plate 2 is shown to include a plate 3 whose bottom edge is in direct contact with the plowing surface. The plate 3 is called herein a rider plate, and it is disposed essentially parallel to the surface being plowed in order to serve as a bearing for the blade structure assembly 30. A plurality of parallel-directed triangular-shaped, steel ridges 4, are welded onto the planar steel plate 2. The chief function served by the steel ridges 4 is to provide apparatus to break and shear the various layers of ice and hardened snow which lie in the path of the plow. Hereinafter, the plurality of ridges 4 are called scraper ridges.

At this juncture it is appropriate to describe briefly the physics of the phenomena occurring around or about the blade connection mechanism and to further explain how the present plow design offers an additional advantage over conventional blade designs, i.e., how it minimizes the abrasive and frictional forces acting upon the point of contact between the plow blade and its plowing surface.

During the course of plowing, the accumulated plowing material 105 in FIG. 9 exerts a reactive force against the planar surface 2, as does, also, the shearing action of the hardened ice and compressed snow which is being pried (off and away) from the plowing surface layer by layer. These forces thereby create directed forces that provide a dynamic lift on the bottom plate 2 to push the blade structure assembly 30 upward against the gravitational force component and against a net downward force component generated by the snow 107; the latter force acts upon the plow blade surface 1A and it also creates an induced moment about pins 92A and 92B (FIG. 1) which forces the L-shaped A-frame (A-frame assembly 90 in FIG. 1) and the blade structure assembly 30 downward. The overall net effect of both types of forces operates to minimize the abrasive and other frictional forces acting upon the rider plate 3.

Figure 4:
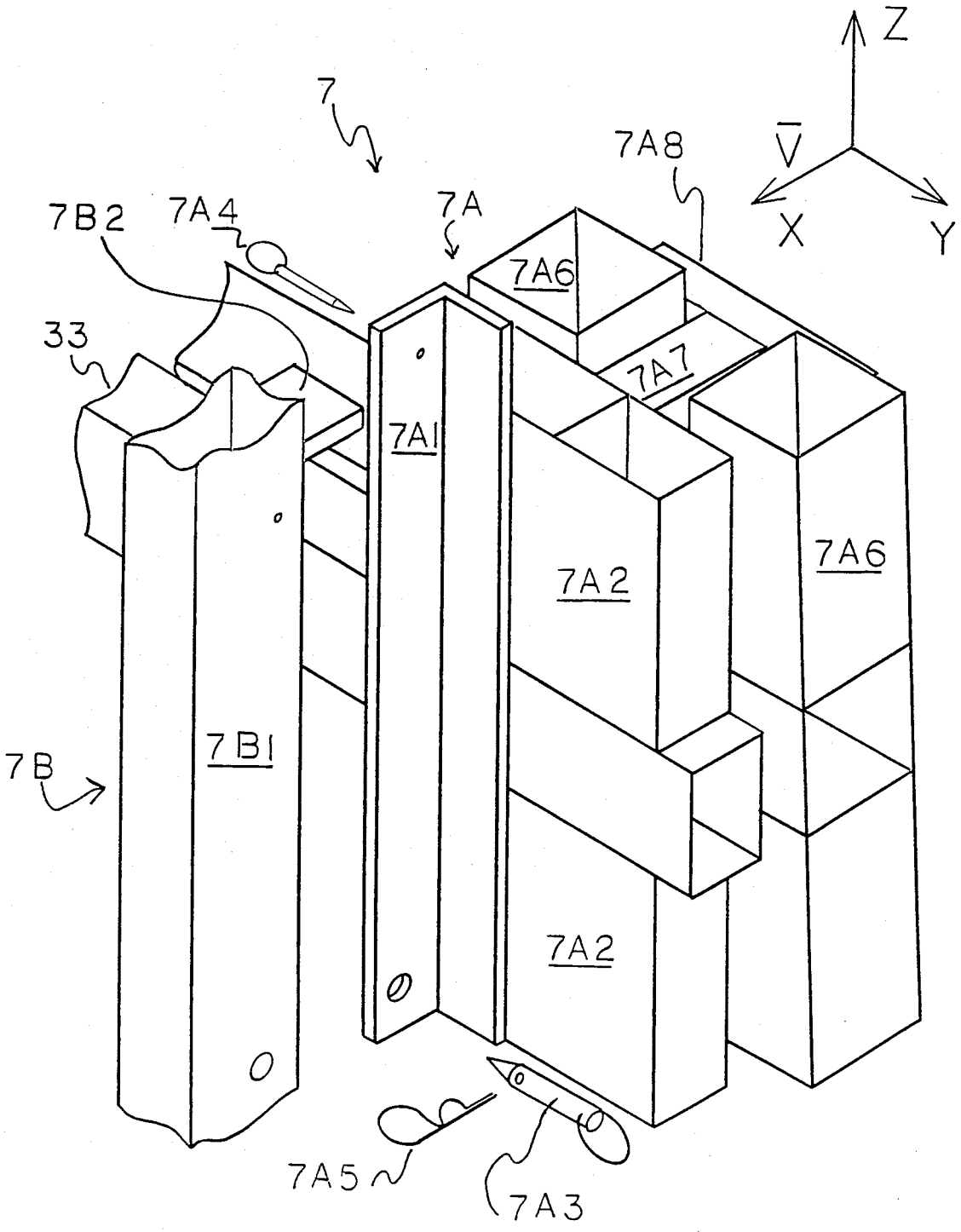
FIG. 4 is rear, isometric view showing the right quick-release mechanism and thrust boxes of the two (which are) incorporated into the present invention.

Another feature of the present plow is that the A-frame assembly 90 and the blade structure assembly 30 in FIG. 1 each make use of a quick-release mechanism which permits the blade structure mechanism 30 to be easily removed from and attached to the A-frame assembly 90 of the plow system. The quick-release mechanism (disposed between the blade structure mechanism 30 and the blade connection mechanism 60) is shown in FIG. 4. In the particular application, e.g., snowplowing, the blade structure assembly 30 has attached to it, two quick-release mechanisms, but in FIG. 4, only the right side mounted one is shown, and in actuality, two of them are necessary and thus do exist between blade structure mechanism 30 and the blade connection mechanism 60. This mechanism, as previously noted, provides a way by which the BSA 30 can be easily attached to and removed from the remaining assemblage of the plow.

The plow 101 includes left and right quick-release mechanisms 7' and 7, respectively, (FIG. 1); the quick-release mechanism 7 is shown in FIG. 4 to include two major components: one component, 7A, is provided by the blade connection mechanism and its subcomponents are marked 7A1–7A8; the other half of the mechanism is provided by the BSA 30 and it is marked 7B, its subcomponents being marked 7B1 and 7B2. Focusing upon the BCM half of the quick-release mechanism 7, it is shown to include a vertically oriented angular member or grab post 7A1. The grab post 7A1 is welded to the end of a front roll beam 33 of the blade connection mechanism. The entire front roll beam 33 is shown from two different perspectives in FIGS. 5A and 5B and is attached to the blade connection mechanism by a roll pin 32. In FIG. 4, the vertically oriented box section 7B1 has a guide plate 7B2 welded to its top. Thus, when the box section 7B1 makes contact with the vertical grab post 7A1, the blade connection mechanism is raised, which causes the BSA 30 to be pulled into alignment with the blade connection mechanism 60. A pitch pin 7A3 slides through the lower hole and is held in place by a removable cotter pin 7A5. A shear pin 7A4 (and 7A4') slides through the upper holes predrilled therein. Thus, when the bottom edge of the blade strikes an obstructing object which is higher than the object clearance threshold, denoted d in FIG. 9, the shear pins 7A4 and 7A4' break, and the blade structure assembly 30 soon thereafter pitches forward about the pitch pins 7A3 and 7A3' (left and right pins) and the blade rides over the object.

Focusing now on the blade component half 7B of the quick-release mechanism, it is shown to consist of several subcomponents. The vertically oriented box section 7B1 mounted to the back of the blade by way of subcomponents 6A and 6B in FIG. 2, is also shown in FIG. 4. The box section 7B1 is welded parallely onto the substantially linear section of the right-curved backbone rib 6A, which is shown in FIGS. 1 and 2, providing front and rear perspectives, respectively. Completing the picture of the blade structure assembly component of the quick-release mechanism 7B, there is an additional subcomponent welded onto the vertically disposed reinforcing rib. This subcomponent is the flat lip structure or guide plate 7B2 which protrudes off the top side of the box section and which interfaces with the top of the grab post 7A1. When both the grab post 7A1 and the structure 7B2 interface with each other, making physical contact, the rectilinear dimension of the grab post will make contact with and lie against the flat face of the box section 7B1.

Figure 5A:
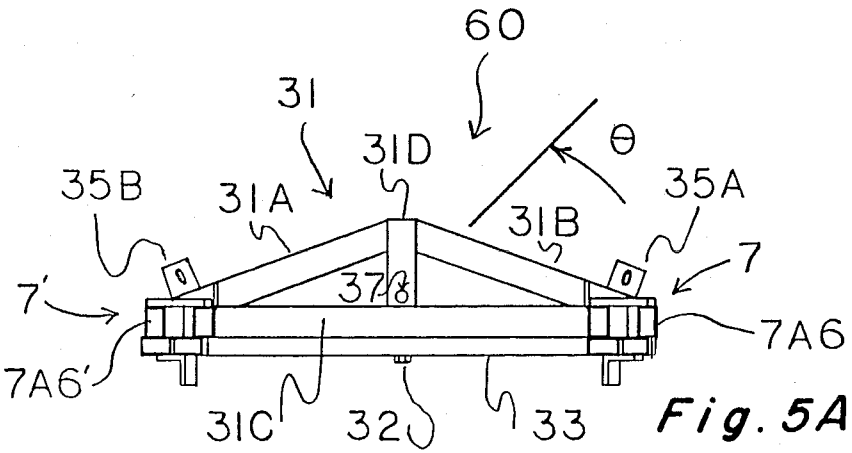
FIG. 5A is a top, orthographic view showing the blade connection mechanism of the present invention which has a front beam attached thereto via the roll pin and which ends of front roll beam are constrained by the left and right thrust box mechanisms which are welded onto the front ends of blade connection mechanism.

The second major component of the plow system 101 is the blade connection mechanism 60 which possesses three degrees of freedom with respect to the A-frame 90. The blade connection mechanism 60 is shown in isolation in FIGS. 5A, 5B, and 5C, each of which, by showing the blade connection mechanism 60 from a different perspective, provides insight into the nature of each of the three degrees of freedom. In FIG. 5A, the blade connection mechanism 60 is shown to exhibit the range of angular displacement that the blade connection mechanism can yaw while it is pinned by the yaw pin 37 between the upper and lower structures 61 and 62 of the AFA in FIG. 6C. The angular displacement that the blade connection mechanism 60 can move through is the yaw angle $\theta$ in FIG. 5A. In FIG. 5A, the BCM 60 is shown to have several members: an isosceles A-shaped structure 31 is formed by assembling the left member of an A-shaped structure 31A and the right member 31B thereof with a main support beam 31C and with a post member 31D that together constitute the frame of the blade connection mechanism 60. To provide a structure around which the blade connection mechanism 60 can yaw, the yaw pin 37 goes through a hole made at the intersection of the post member 31D with the main support beam 31C as shown in FIG. 5A. The yaw pin 37 acts as an axis about which the blade connection mechanism is permitted to pivot through a range of plus or minus forty-five degrees, as indicated against the superimposed coordinate frame of reference. To provide a way by which the blade structure assembly can manifest an additional degree of freedom, the front roll beam 33 is held by the roll pin 32; the roll pin fits into a hole in the main support beam 31C of the blade connection mechanism.

Figure 5B:
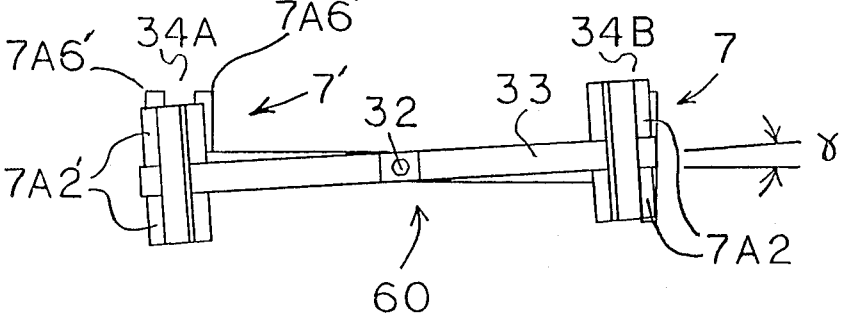
FIG. 5B is a front, orthographic view of the blade connection mechanism of the present invention, showing how the front beam connected thereto is delimited by the placement of the left and right thrust box mechanism welded thereon.

FIG. 5B is offered to show the second degree of freedom that the blade connection mechanism 60 provides to the blade structure assembly. This degree of freedom is denoted roll, and the range of angular displacement that the front roll beam 33 and the blade structure assembly attached thereto via the quick-release mechanism can undergo, is marked by the angle $\gamma$. It will be noted that the range of roll angle excursion is delimited by the two thrust box mechanisms 34A and 34B disposed at left and right ends of the main support beam 31C of the blade connection mechanism, respectively, as shown in FIG. 5B. An enlarged drawing of a single thrust box mechanism with the quick-release mechanism is shown in FIG. 4 and is discussed above.

Figure 5C:
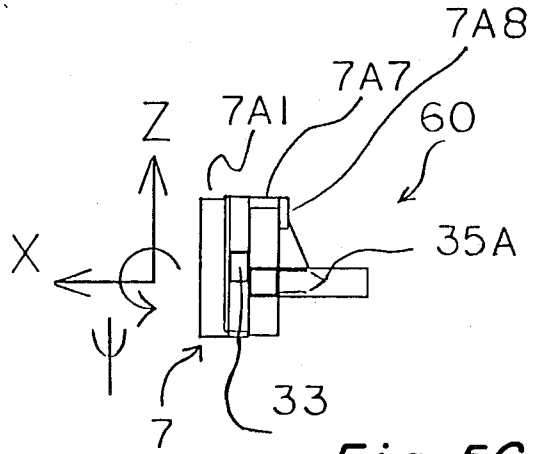
FIG. 5C is a side, orthographic view of the blade connection mechanism showing how the blade is free to roll about the blade connection mechanism roll pins and how the ends of the blade may move up and down within the spatial boundaries established by the top and bottom plates of the thrust box mechanisms.

Finally, in FIG. 5C, the third degree of freedom that the blade connection mechanism 60 provides to the blade structure assembly 30 is denoted $\psi$, this being the angular excursion through which the blade structure assembly 30 can tip forward when the blade strikes an object protruding from the surface being plowed. This degree of freedom is referred to as pitch and its limits are set by two pitch pins (i.e., the pitch pin 7A3 and 7A3' in FIG. 1) and two shear pins (i.e., the shear pin 7A4 and 7A4' in FIGS. 1 and 4) which attach the blade structure assembly 30 to the blade connection mechanism 60. In the event that the height of the encountered object is substantially greater than d (FIG. 9), as previously indicated, the protective mechanism operates (i.e., the shear pins fail) to prevent damage from occurring to the major plow components.

By placing the blade structure assembly 30 within such a configuration, it can effectively transfer loads and moments to the blade connection mechanism which have been generated about any three perpendicular axes thereto, while, at the same, gaining the protective benefits offered by such a scheme. The mechanism that allows the blade connection mechanism to handle pitch and roll moments is now discussed with reference mostly to FIGS. 1, 4, 5A, 5B and 5C.

The front roll beam 33 has vertical posts 7A2 and 7A2' which transfer plow loads that are in line with the forward motion of the truck 102 to the vertical posts 7A6 and 7A6' which are welded to the support beam 31C of FIG. 5A. These loads are then further transmitted from the blade connection mechanism 60 to the A-frame assembly 90, and thence to the truck. Moment straps 7A7 and 7A7 limit the amount of roll that the front roll beam is permitted to undergo. With reference to FIG. 5B, the right moment strap 7A7 serves to limit the amount of clockwise roll that the front roll beam may undergo about the roll pin 32. This limit is established by the section of the moment strap that passes between the posts 7A6 hitting against the main support beam 31C, thus delimiting its angular displacement about the roll pin 32. Similarly the left moment strap 7A7' in FIG. 1 limits the amount of counterclockwise roll.

The right moment strap 7A7 is welded to the front roll beam 33 and passes between the vertical posts 7A6. The thickness of the moment strap must be less than the spacing of the vertical posts for the blade to roll. The plate 7A8 is welded to the other end of the moment strap. This effectively sandwiches the two upper vertical posts 7A6 between the upper vertical post 7A2 and the plate 7A8. Thus, pitch moments generated about the y axis can be transferred from the blade to the blade connection mechanism 60 and A-frame assembly 90. As is to be explained in a later section addressing the physics of the A-frame assembly 90, these moments produce forces which help keep the blade on the ground during plowing. Translational movement of the front roll beam 33 along the y axis of FIG. 4 is prevented by the roll pin 32, which is in a shear orientation for such motions.

The description of the blade connection mechanism 60 and its subcomponents is completed by making reference to FIG. 5A and pointing to the two parallel flange plates 35A and 35B that are welded perpendicularly to the rear ends of the blade connection mechanism 60. The flanges 35A and 35B provide a way to attach double pulley blocks of the electric winch/cable system, to the blade connection mechanism. These flanges provide a way by which the blade connection mechanism and all components attached thereto, can be angularly displaced in the direction of the defined yaw angle $\theta$ in FIG. 5A.

Figure 6A:
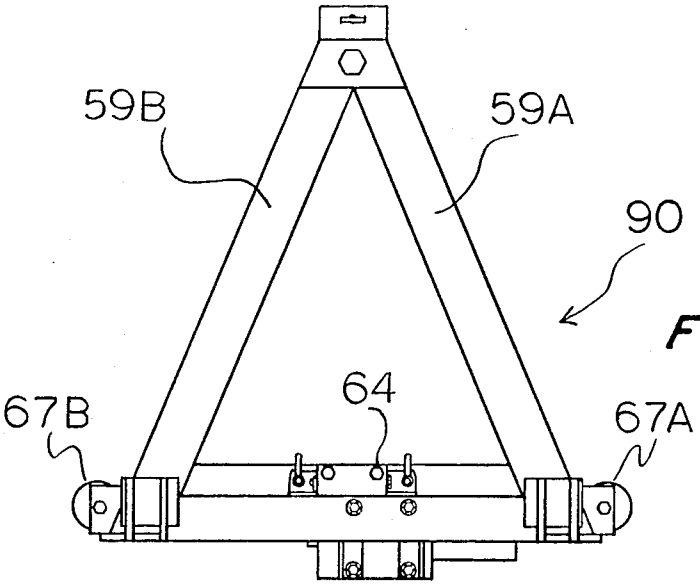
FIG. 6A is a top, orthographic view showing the A-frame assembly, the two post-mounted single pulleys fastened thereon and the electric winch motor bolted thereto.
Figure 6B:
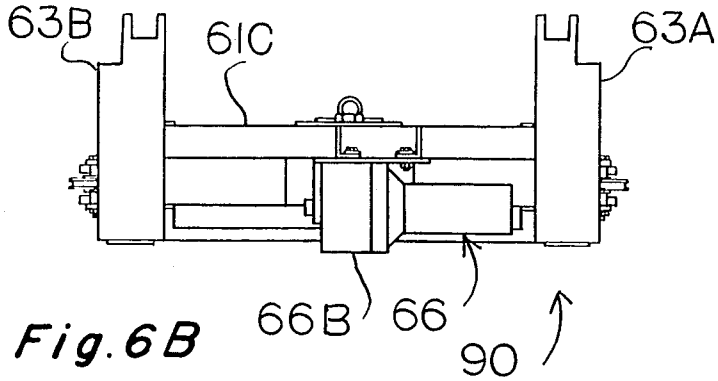
FIG. 6B is a rear, orthographic view showing the left and right posts of the present invention which connect upper and lower A-frame structures, and showing the rear of the electric winch motor which drives the yaw control subsystem which is not shown therein.
Figure 6C:
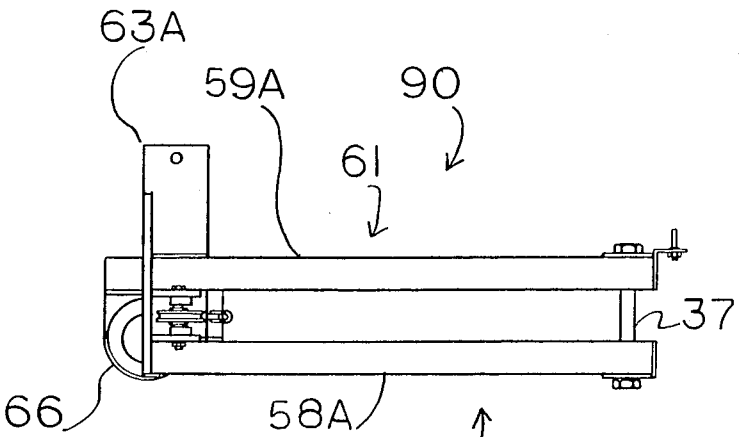
FIG. 6C is a side, orthographic view showing the A-frame assembly upper and lower A-frame structures, and the right post, single pulley, and yaw pin part thereof.
Figure 8:
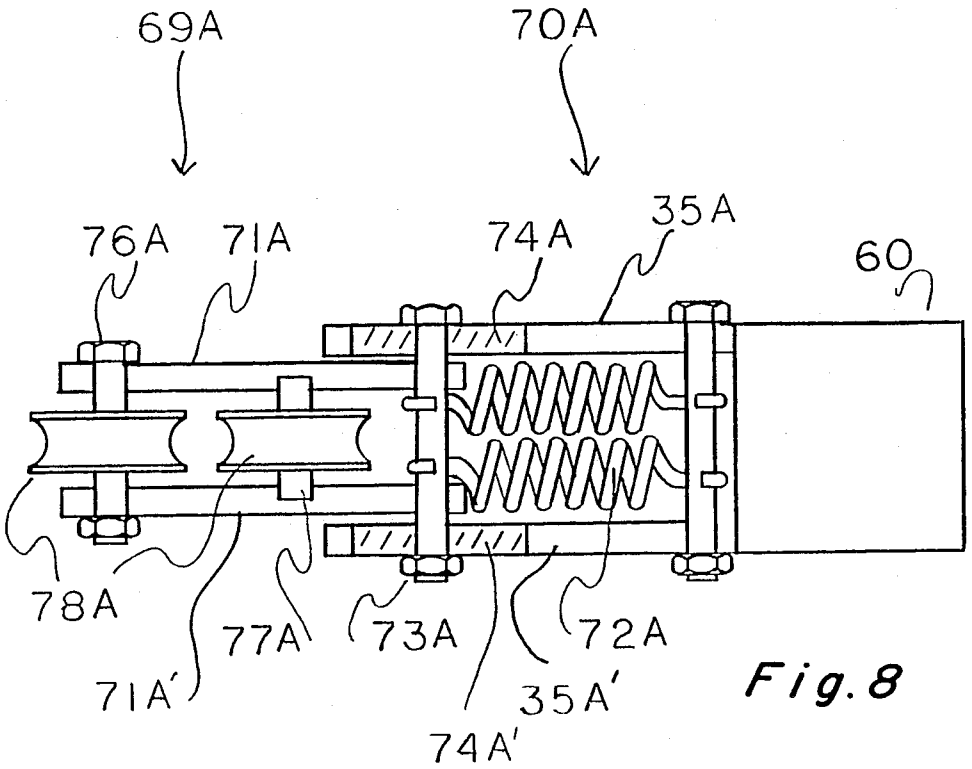
FIG. 8 is a side view of one (of two) spring loaded slack control mechanisms, which help take up slack in the yaw control cables.

Turning now to FIGS. 6A, 6B, and 6C, the third major component of the plow system, the A-frame assembly 90, is shown from three views, and it has attached to it an electric winch motor 66, which is used to angle the BSA 30 through its range of yaw angles by using the cable pulley system shown in FIG. 1, and more clearly in FIG. 8.

The chief purpose of the A-frame assembly 90 are to provide a way by which the blade connection mechanism 60 and the blade structure assembly 30 can be allowed to move through an angular displacement in the direction of yaw angle $\theta$ and to provide a way to transfer blade loads to the plow vehicle 102, as well as to allow the crane 103 in FIG. 1 to raise the L-shaped A-frame thereof to a substantially vertical position when the plow is not is use in order to permit, among other things, the vehicle to climb steep inclines.

In FIGS. 6A, 6B, 6C, and 7, the A-frame assembly 90 is shown to have two major subcomponents: (1) an upper A-frame structure 61; and (2) a lower A-frame structure 62, where both subcomponents are welded parallel to each other at their base ends by the left and right posts 63A and 63B, respectively. The apexes of both the upper A-frame 61 and lower frame 62 have the blade connection mechanism 60 inserted therebetween with the yaw pin 37 going orthogonally through the blade connection mechanism and the two A-frame structures, thereby allowing the blade connection mechanism to pivot freely within a predetermined plane. The resulting geometry of the A-frame assembly is an L-shaped A-frame, where: (1) short legs 63A and 63B of the frame connect the upper and lower A's to the vehicle; and where (2) the long legs 58A, 58B, 59A and 59B of the frame are connected to the blade connection mechanism 60. The dimensions of the short legs, the long legs and the attachment location of the A-frame assembly to the blade connection mechanism 60 are chosen to give an attachment location, such that, when a negative x-direction force is applied to the blade at the lower edge thereof in the course of plowing, a moment is created about pivots 92A and 92B, which moment produces a net downward force upon the rider plate 3 in order to keep that plate in contact with plowing surface during the course of plowing.

The physics of the L-shaped A-frame are as described below. Plowing forces act parallel to the A-frame 61 and 62. Because the posts 63A and 63B are connected at their tops, a net downward force is created in the negative Z direction. This helps keep the blade's rider plate 3 in FIG. 3 on the ground. The L-shape also allows the A-frame assembly 90 to be raised to a near vertical position, by holding the A-frames 61 and 62 out in front of the front bumper. It will be noted that this unique shape could well be used with a conventional plow blade if it was desired to rigorously scrape the road surface. However, this action would result in increased blade wear and possibly unnecessary road damage. But in the case of airports, where, for instance, the runways must be totally free of ice, such forceful scraping action is necessitated; and seeing that such surfaces are usually made of concrete, there appears to be less likely chance that such scraping action will cause significant damage thereto.

Figure 7:
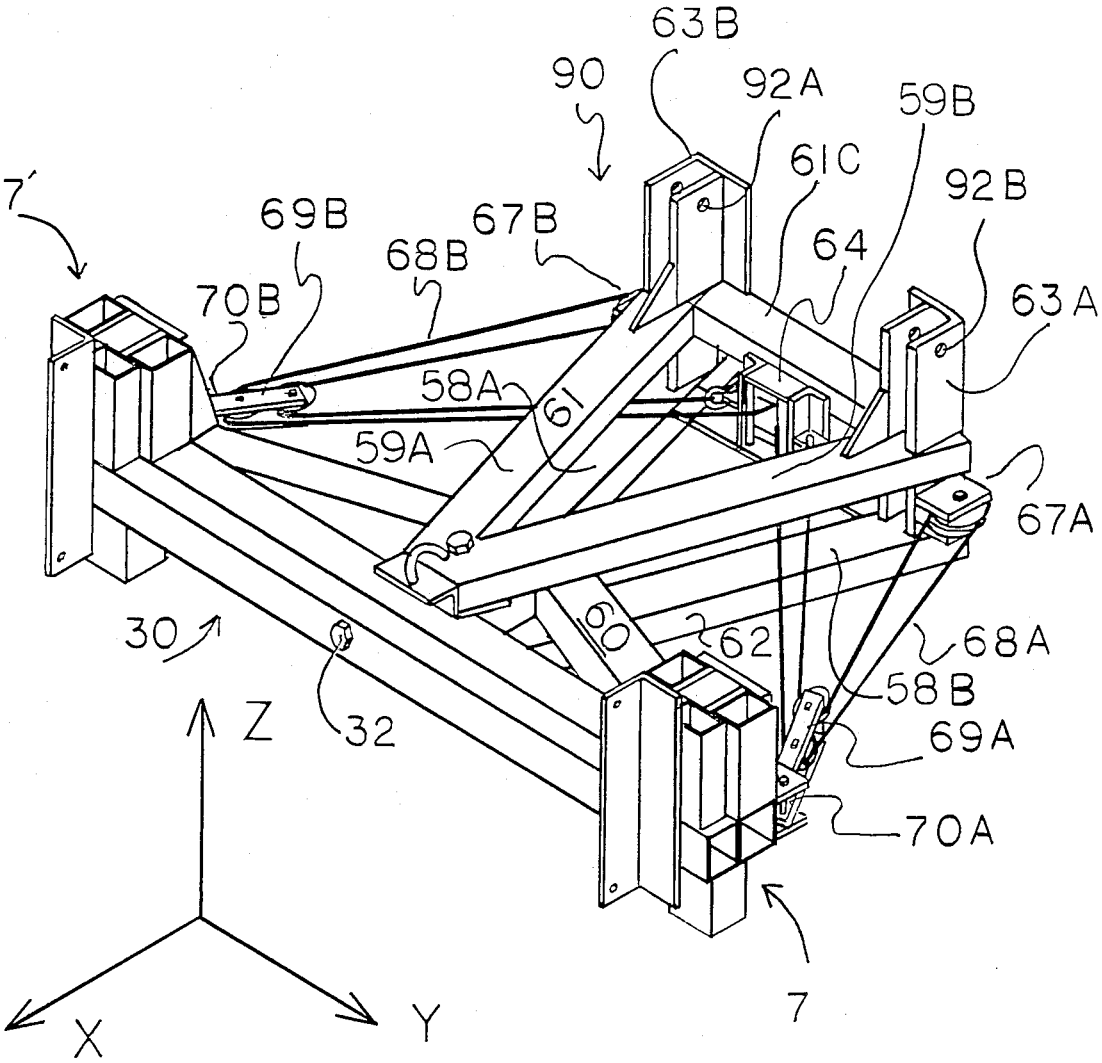
FIG. 7 is a top front, isometric view showing the blade connection mechanism of the present invention and the A-frame assembly and the control cable subsystem thereof, where the blade structure assembly of the present invention is not shown therein.

Turning to FIG. 7, the blade angling control system is shown to include among other plow structures: (1) an electric winch 66 (located behind a fairleader 64) mounted to the base beam 61C (FIG. 6B) of the upper A-frame 61; (2) two sets of control cables 68A and 68B connecting the winch 66 (FIG. 6C) to the blade connection mechanism 60 at the ends thereof; (3) two sets of double pulleys 69A and 69B attached to the ends of the blade connection mechanism 60 and two sets of single pulleys 67A and 67B attached to the posts 63A and 63B of the A-frame assembly 90, both of which provide a proper mechanical advantage for cables to balance snow forces; (4) the fairleader structure 64 which ensures that control cables unwinding from the drum of the winch will exit therefrom at a plane substantially similar to control cables entering the fair leader and winding upon the same drum; and (5) two slack adjustment mechanisms 70A and 70B which are incorporated into the structure of the double pulleys 69A and 69B, respectively.

The function of the blade angling system is to provide a way to orient and to hold the blade at a position of yaw about its vertical axis, and thus permit the blade to be disposed at an angle to the direction of movement of the vehicle in the course of plowing.

Control of the blade component 30 is achieved as follows. The winch 66 in FIG. 6B has a drum 66B connected thereto that is divided into two halves, one half serving to play out one set of cables while the other half winds in the other set of cables in order to permit orientation of the blade about its vertical axis. Each set of cables extends away from the drum of the winch, first passing through the fair leader 64, then forming a particularly designed path through its respective double pulley/slack adjustment mechanism, the latter being attached to the flanges 35A and 35B, and through its respective single pulley 67A/67B (attached to the A-frame assembly 90), eventually terminating at an anchored point on the outside of the fair leader structure 64. The electric winch motor 66 in FIG. 6C, being controllable from within the cab of the vehicle, allows the driver to activate the winch motor 66, and thereby to rotate the winch drum 66B in a particular direction, which pulls in and lets out the two sets of control cables 68A/68B in FIG. 7. Thus, the driver can angularly displace the blade structure assembly 30 to a desired orientation with respect to the vehicle's forward motion axis. Any slack in the control cables 68A and 68B that might be occasioned by such angular adjustment from one orientation of the blade to another orientation is taken up by the slack adjustment mechanisms 70A and 70B, thereby permitting a proper control cable tension to be maintained during the course of plowing.

A side view of slack control mechanism 70A and pulley block 69A is shown in FIG. 8. Two plates (an upper and lower) 71A and 71A' are pinned to a bolt 73A at one end to plates 35A and 35A' which are attached to the blade connection mechanism 60. The plates 35A and 35A' have slots 74A and 74A' cut in them (shown by dashed lines). The bolt 73A passes through the slots and through round holes machined in the pulley plates 71A and 71A'. Bolts 76A and 77A in the pulley plates hold sheave 78A in place. When cable slack is present, springs 72A draw the bolt 73A and the plates 71A and 71A' back into the slot, thereby reducing cable slack. When the springs extend, they act to release cable tension within the cable pulley system.

In order to raise and lower the plow from operating and nonoperating positions, a steel support structure 110 is bolted to the front bumper as shown in FIG. 1. A bumper mounted winch cable passes over a sheave and to the tip of the A-frame. The use of a winch allows the A-frame to be raised to a near vertical position when the blade is disconnected for ease in transportation. Notably, existing plows use a hydraulic or pneumatic cylinder to raise an A-frame assembly 90. By using a winch, one gains a useful tool in the off season, or for pulling people out of ditches during the winter.

Further modifications of the invention herein disclosed will occur to persons skilled in the art and all such modifications are deemed to be within the scope of the invention as defined by the appended claims.

I claim:

1. A plow to effect plowing action of a material at a surface, that comprises:

a blade having an arcuate-shell face region and bottom plate means that interfaces with the material at the surface being plowed, said bottom plate means being secured to and extending along the lower edge of the arcuate-shell face region and being disposed at an angle $\phi$ to the portion of the face region of the blade to which it is secured, said bottom plate means being wide enough to place the upper portion thereof above rigid obstacles usually encountered in the course of plowing, wherein the angle $\phi$ is the external angle formed between the face region of the plow blade and the bottom plate means at the junction of the two structures and is an angle greater than 180° and less than 360° and said bottom plate makes an angle $\alpha$ with the surface to be plowed of not less than 0° and not more than 90°;

a frame for attaching the blade to a vehicle, said frame being geometrically configured to counteract, in the course of said plowing action, dynamic lift forces exerted upon the bottom plate means; and a blade connecting mechanism to attach the blade to the frame, the face region, when plowing is being achieved, being disposed to have a substantial vertical component, the bottom plate means comprising a plate whose bottom edge in contact with the material is a rider plate disposed at an angle to the first named plate, which rider plate is disposed essentially parallel to the surface during plowing, which surface serves as a bearing therefor, said material, in the course of plowing, providing dynamic lift to decrease wear of the rider plate that would otherwise occur, said frame being an L-shaped A-frame wherein the short leg of the L pivotally connects the plow at the vehicle attachment end of the plow to the vehicle to serve as a pivot attachment end of the frame to the vehicle and the long leg of the L is connected through the blade connection mechanism, to the blade, the dimensions of the short leg of the L, and hence the pivotal attachment location of the frame to the blade, being chosen to give an attachment location such that, when a force is applied to the blade at the lower edge thereof in the course of plowing, a moment is created about the pivot at the pivot attachment end of the frame to the vehicle, which moment produces a net downward force upon said rider plate to keep the rider plate in contact with said surface.

2. A plow according to claim 1 in which the frame is an A-frame and in which the blade is easily removably attached to the A-frame.

3. A plow according to claim 1 in which the blade connecting mechanism is adapted to give the blade three degrees of freedom with respect to the frame.

4. A plow according to claim 1 having means to raise the L-shaped A-frame to near vertical position when the plow is not in use to permit the vehicle to climb sharp inclines.

5. A plow according to claim 4 wherein the blade connecting mechanism allows the blade to yaw about a vertical axis with respect to the A-frame, said blade being attached to two posts of the blade connecting mechanism by two pitch pins, one pitch pin being received by an aperture near the bottom of each post, and by two shear pins, one shear pin being received at an aperture near the top of each post, which shear pins break when excessive forces are applied upon such plate in the course of plowing, allowing the blade to pitch about the pitch pins in the event that the bottom of the blade strikes a rigid object that the inclined plate cannot surmount.

6. A plow according to claim 5 wherein the two pitch pins and the two shear pins are removable to permit disassembly of the blade from the frame and wherein the frame, without the assembled blade, can be raised so that said long leg is disposed in substantially a vertical position with respect to said surface.

7. A system that includes the plow of claim 5 and that further includes an electric winch mounted at the back of the A-frame and control cables connecting the winch to the blade to hold the blade at a position of yaw about said vertical axis to permit the blade to be disposed at an angle to the direction of movement of the vehicle in the course of plowing.

8. A system according to claim 7 wherein the cables are strung over pulleys which give a proper mechanical advantage to the cables over snow forces and which permit adjustment of the cables in tension to overcome differences in tension thereon occasioned by pivoting of the blade about said vertical axis.

9. A system according to claim 8 having two sets of cables, one set connecting the winch to one end of the blade and the other set connecting the winch to the other end of the blade via the blade connection mechanism and in which the winch has a drum that is divided into two halves, one half serving to play out one set of cables while the other half winds in the other set of cables to permit orientation of the blade about said vertical axis.

10. A system according to claim 9 in which the cables are wound upon the drum in such a way that little slack is occasioned in the course of adjusting cable settings from one orientation of the blade to another orientation of the blade and that further includes cable tension means to permit cable tension to be maintained.

11. A system according to claim 10 in which the cable tension means comprises springs attached to the pulleys in such a way that spring pressure maintains a predetermined tension on the cables.

12. A system according to claim 9 in which the cables that are wound on one half of the drum wind in to form a roll of increasing size while the cables that are wound on the other half of the drum wind out to form a roll of decreasing size, the relative rates of winding in and winding out being predetermined to minimize slack in the course of the winding operation.

13. A plow according to claim 5 in which the blade connecting mechanism provides three degrees of freedom with respect to the frame, in which the blade connecting mechanism comprises a main support beam and a front roll beam, whose lengths are oriented parallel to the length dimension of the blade, in the main support beam being held to the front of the frame by a vertically-oriented yaw pin which allows the support beam to be disposed at an angle to the direction of movement of the vehicle in said course of plowing, to permit plowed material to be propelled to one side or the other of the vehicle.

14. A plow according to claim 13 in which the front roll beam is connected to the main support beam by a roll pin whose axis lies in the direction of forward motion of the vehicle and is connected to the blade by the pitch pins and roll pins to allow the lateral center of the blade to roll (pivot) about a central horizontal axis in both clockwise and counterclockwise directions to permit the blade to follow contours in said surface.

15. A plow according to claim 14 in which the front roll beam and the main support beam have vertical posts at their ends which rub on each other when said roll beam rolls, allowing the roll beam to transfer compressive plowing loads from the blade to the roll beam, thence to the support beam and then to the frame.

16. A plow according to claim 15 in which the vertical posts on the roll beam are held to the vertical posts on the support beam by a moment strap which aids the roll beam in transfer of moments from the blade to the roll beam to the support beam to the frame, the moment strap being connected to a plate located behind the vertical post on the support beam, effecting sandwiching the vertical post on the support beam between said plate and vertical post on roll beam, to allow only near vertical relative motions of the two said vertical posts corresponding to small clockwise or counterclockwise motions of the roll beam.

17. A plow according to claim 15 in which the blade is connected at each end to the bottoms of the vertical posts of the roll beam by a pitch pin, and to the top of said posts by a shear pin, the shear pin serving to allow the blade to pitch forward and pass over an obstacle, thus preventing forces above some predetermined value from being transmitted from a rigid object on said surface to the vehicle.

18. A plow according to claim 17 that further includes:

a winch and control cables connecting the winch to the blade to hold the blade at a position of yaw about a vertical axis to permit the blade to be disposed at an angle to the direction of movement of the vehicle in the course of plowing, said cables being strung over pulleys which give a proper mechanical advantage to the cables over forces tending to pivot the blade about the vertical axis and permit adjustment of the cables in tension to overcome differences in tension thereon occasioned by pivoting of the blade about the vertical axis in the source of adjustment;

spring means attached to the pulleys in such a way that spring pressure maintains required tension on the cables, said pulleys being attached to the main support beam near the vertical posts to render the blade easily disasembled from the frame without disconnecting the system employed to alter the yaw angle of the blade.

19. A plow according to claim 1 in which the bottom plate means has vertical ridges which project forward, to aid said plate means in the removal of ice from said surface.

* * * * *